US008048265B2

(12) United States Patent
Amonarria Azcolain et al.

(10) Patent No.: US 8,048,265 B2
(45) Date of Patent: Nov. 1, 2011

(54) CREPING AND CUTTING PROCEDURE AND EQUIPMENT

(76) Inventors: Jose Joaquin Amonarria Azcolain, Tolosa (ES); Jose Miguel Echeberria Goicoechea, Tolosa (ES)

( * ) Notice: Subject to any disclaimer, the term of this patent is extended or adjusted under 35 U.S.C. 154(b) by 436 days.

(21) Appl. No.: 12/277,789

(22) Filed: Nov. 25, 2008

(65) Prior Publication Data

US 2009/0139672 A1 Jun. 4, 2009

Related U.S. Application Data

(63) Continuation-in-part of application No. PCT/ES2007/000271, filed on May 9, 2007.

(30) Foreign Application Priority Data

May 25, 2006 (ES) ..... 200601372

(51) Int. Cl.
*D21G 9/00* (2006.01)
*D21G 3/04* (2006.01)
*D21F 7/00* (2006.01)
*B31F 1/14* (2006.01)

(52) U.S. Cl. ..... 162/111; 162/194; 162/281; 162/286; 118/413; 15/256.51; 156/183; 264/283

(58) Field of Classification Search ..... 162/111, 162/194, 280–281, 286, 272; 118/413; 15/256.5, 15/256.51; 83/37, 119, 399; 242/522, 523.1, 242/526; 156/183; 264/282–283
See application file for complete search history.

(56) References Cited

U.S. PATENT DOCUMENTS 1,484,498 A * 2/1924 Hildebrandt ..... 242/417
3,065,486 A * 11/1962 Baliol ..... 15/256.51
3,507,745 A * 4/1970 Fuerst ..... 162/281
5,403,446 A * 4/1995 Trelsmo et al. ..... 162/281
5,622,601 A * 4/1997 Adams et al. ..... 162/194
5,674,361 A 10/1997 Marinack
5,852,963 A * 12/1998 Koponen et al. ..... 83/53
5,944,958 A * 8/1999 Svanqvist ..... 162/281
6,474,205 B1 * 11/2002 Halmschlager et al. ..... 83/24
7,947,152 B2 * 5/2011 Amonarriz Azcolain et al. ..... 162/281
7,972,481 B2 * 7/2011 Amonarriz Azcolain et al. ..... 162/272
2009/0139672 A1 * 6/2009 Amonarriz et al. ..... 162/111
2010/0018661 A1 * 1/2010 Amonarriz Azcolain et al. ..... 162/272
2010/0300638 A1 * 12/2010 Amonarriz Azcolain et al. ..... 162/272

FOREIGN PATENT DOCUMENTS

EP 2031128 A1 * 3/2009
EP 2175068 A1 * 4/2010
ES 2010790 A 12/1989
WO 9532334 A 11/1995
WO WO 2007138128 A1 * 12/2007

* cited by examiner

*Primary Examiner* — Jose A Fortuna

(74) *Attorney, Agent, or Firm* — Lucas & Mercanti, LLP

(57) ABSTRACT

Creping and cutting procedure and equipment, for paper manufacture which consists of a creping doctor (1) carrying a blade (2) which carries out the creping; a support plate (12) which can pivot on a pivot shaft (5) in the geometrical center of which the creping blade (2) works; primary means of actuation (3) which through the support plate (12) cause the rotation of the creping doctor (1) on a pivot shaft (4); and secondary means of actuation of variation of angle (6) which act on the support plate (12) and cause its rotation on a pivot shaft (5) ; in such a way that it is possible, with only two doctors (1), (7) to carry out the maneuvers of creping, blade changing, cutting and cleaning.

4 Claims, 7 Drawing Sheets

CREPING AND CUTTING PROCEDURE AND EQUIPMENT

CROSS REFERENCE TO RELATED APPLICATIONS

This is a Continuation-in-part of International Patent Application No. PCT/ES2007/000271, filed May 9, 2007, which claimed the priority of Spanish Patent Application No. P2006/01372 filed May 25, 2006, the priority of both Applications is claimed and both Applications are incorporated herein by reference.

FIELD OF THE INVENTION

This Invention refers to a procedure and facility for creping and cutting of a continuous band of paper which moves on a drying cylinder, as well as for cleaning of said drying cylinder, on machines for paper manufacturing.

BACKGROUND OF INVENTION

Machines for paper manufacturing have progressed technologically bringing about an increase in speed of manufacturing and in the widths of the paper band manufactured. Currently, paper manufacturing machines, mainly of crepe paper, manufacture of speeds around 2000 m/min., and with paper band widths of up to 8 meters.

On said machines it is necessary that an essential element for connect and rapid execution of the paper, as in the facility of creping equipment (doctors), should have elements that are precise, durable and reliable, which adapt the creping blade or element to the surface of the cylinder, that said blade can be substituted, when worn, rapidly, without interruption of the paper band, and allows cutting and creping of said band, and which also allows changing of the angle of application of the blade on the roller automatically in order to modify the quality of the creping and cut the band.

In the current state of the technique, there are mainly two known types of facility and procedures:

a) In machines which do not allow the installation of three doctors, the procedure is as follows:

1. With the creping and cleaning doctors supported on the drying cylinder turning at the working speed, the Pick Up is closed, taking the paper band through the drying cylinder until said paper band reaches the creping blade. The creping blade unsticks the paper band from the drying cylinder, causing, upon unsticking, wrinkling in the paper band called "creping". This creping can be controlled in various parameters (amplitude, percentage, etc.) through the use of an angle of application of the creping blade. Once the paper band is unstuck and creped, it is rolled on the roller (Pope).
2. When the creping blade, due to its constant friction against the drying cylinder, becomes blunt due to wearing of the edge, it must be changed. In order to do this, it is necessary to remove the creping blade, separating it from the drying cylinder with the action of the pneumatic cylinders on the creping doctor and extracting the creping blade and substituting it with a new one.

At the moment the creping blade is separated, the paper band continues to adhere to the drying cylinder until it is again unstuck by the cleaning blade which is applied with a high angle of application which does not allow creping, but only removes the paper band.

To again apply the creping blade to the roller, and given that the angle of application of the creping blade used to crepe does not allow cutting of the paper band so that the creping blade reaches the drying cylinder (5) entirely, it is necessary to open the Pick Up, thus directing the paper band to the recovery circuit and leaving the drying cylinder without a blade. The creping doctor is applied again and the cycle starts again.

Considerable time is taken in this operation of blade changing, resulting in a significant loss in production.

b) In machines which allow the installation of three doctors, the procedure is as follows:

1. With the creping and cleaning doctors supported on the drying cylinder turning at the working speed, and the cutting doctor removed, the Pick Up is closed, taking the paper band through the drying cylinder until said paper band reaches the creping blade. The creping blade unsticks the paper band from the drying cylinder, causing, upon unsticking, wrinkling in the paper band called "creping". This creping can be controlled in various parameters (amplitude, percentage, etc.) through the use of an angle of application of the creping blade. Once the paper band is unstuck and creped, it is rolled on the roller (Pope roller).
2. When the creping blade, due to its constant friction against the drying cylinder, becomes blunt due to wearing of the edge, it must be changed. In order to do this, it is necessary to divert the paper band toward the recovery circuit, which is done by applying the cutting doctor with the appropriate angle of application to produce a fast and clean cut of said paper band.
3. The creping doctor is removed and the worn creping blade is extracted and is substituted with a new one.
4. The creping doctor is applied again with the appropriate load and angle.
5. The cutting doctor is removed and the facility continues in production.

SUMMARY OF THE INVENTION

The new facility which is the object of the invention operates in such a way that with only two doctors, the manoeuvres of creping, blade changing, cutting and cleaning can be done, all without the need to open the Pick Up, with the same efficiency and safety and in the same time as with an installation with three doctors.

The execution of the manoeuvre is totally automatic and allows the modification of the creping and cutting angles.

The procedure is as follows:

a) The creping and cleaning doctors are applied with the drying cylinder turning at the working speed and with the creping angle on the creping blade and with the cleaning angle on the cleaning blade.

b) The paper sheet or band reaches the creping blade which unsticks and crepes said sheet.

c) When the blade becomes blunt because of its constant friction with the drying cylinder, it should be replaced with a new creping blade. To do this, the creping blade should be disabled by raising the doctor blade by means of the corresponding operating mechanism. The sheet is removed by the cleaning blade and then the worn creping blade is replaced and a new blade set in place. When the doctor blade arrives at the position where the blade has been changed, the operating mechanism varies the angle and automatically operates on the support plates, changing the creping blade angle of application for the operating angle for cutting the sheet of paper. Once the creping blade has been replaced, the creping doctor blade is applied again, but with the corresponding angle of application for the cutting operation. Once the sheet of paper has been cut, the angle of application is modified, passing from the cutting process to the creping process thanks to the action of the angle variation components.

A paper web creping and cutting facility is described, which travels on a drying cylinder inside a paper-making machine, consisting of a structure (b) that supports a creping doctor blade bearing a creping blade that performs the creping process, with the invention being characterized by the fact that it comprises:

a) a support plate that can rotate on the structure (b) around a primary pivot shaft at the geometric axle around which the creping blade operates, with the doctor being able to rotate on the support plate around a secondary pivot shaft;

b) operating mechanism supported by the support plate which is designed to make the doctor blade rotate between the position in which the creping blade is applied to the drying cylinder and a position for changing the blade in which the creping blade is separated from the drying cylinder;

c) a second operating mechanism with angle variation which is supported by a structure (b) and runs on the support plate, being designed in such a way as to make the support plate rotate around the primary pivot shaft in order to vary the angle of application of the creping blade between a cutting angle for the paper web and a creping angle for the paper web.

The advantages to be derived from using the process and the facility forming the object of the invention are clear:

a) modification of the angle of application for the blade by means of remote control, with it being possible to perform this operation equally well with the paper-making machine running or at a standstill, without interrupting production.

b) possibility of changing the angle, so as to be able to work with a single doctor blade being used for cutting and creping.

c) use a crepe paper-making machines with two doctor blades (creping and cleaning).

d) in the machines which allow the use of only two doctors, the need to open the Pick Up for the manoeuvre of creping blade substitution is eliminated, with the resulting savings in working time and paper recycling.

To better understand the object of this invention, a preferable way of its embodiment is shown on the drawings, subject to minor changes which do not fundamentally change it.

DETAILED DESCRIPTION OF THE INVENTION

Figure 1:
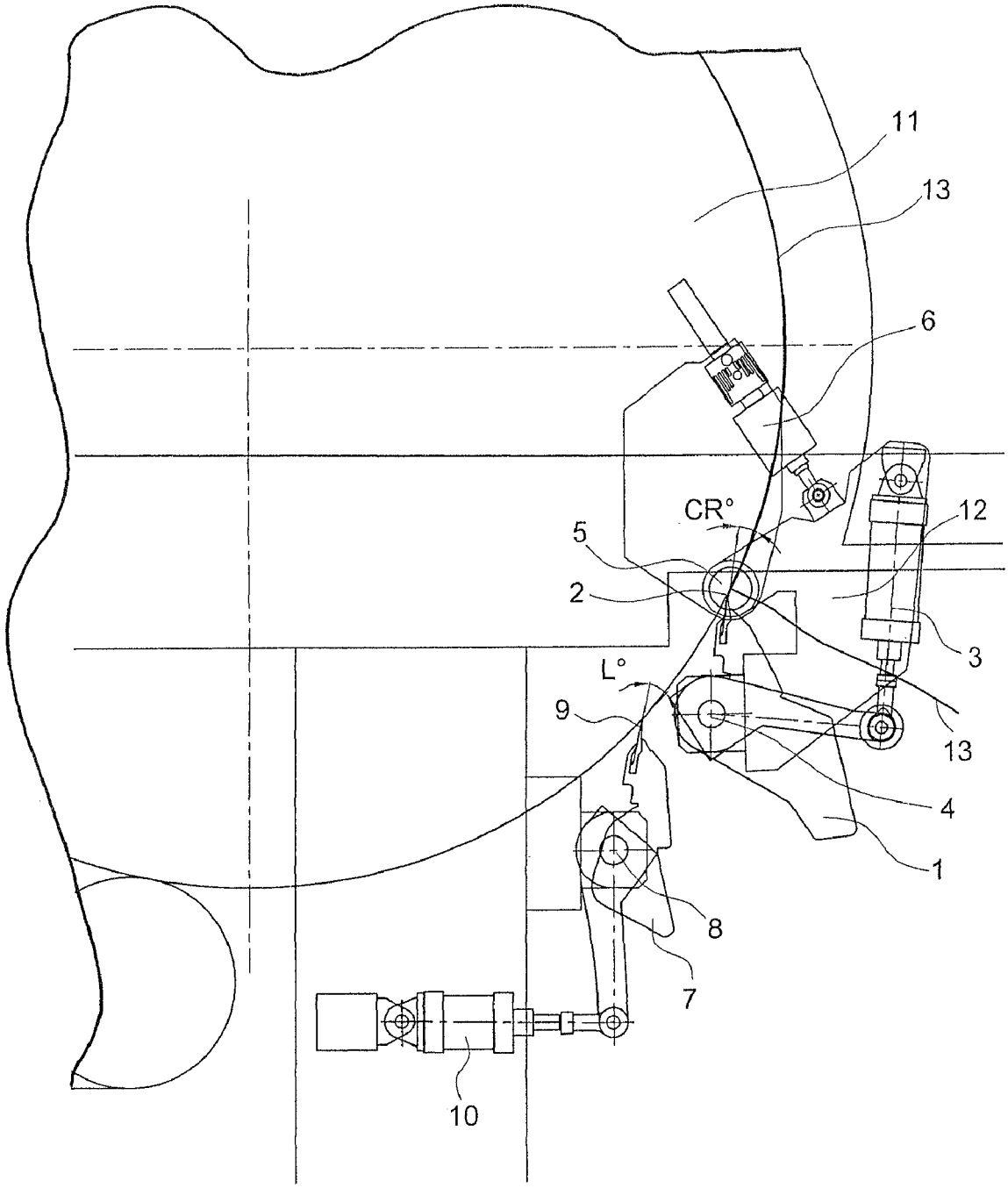
FIG. 1 illustrates the creping and cleaning doctors.
Figure 1A:
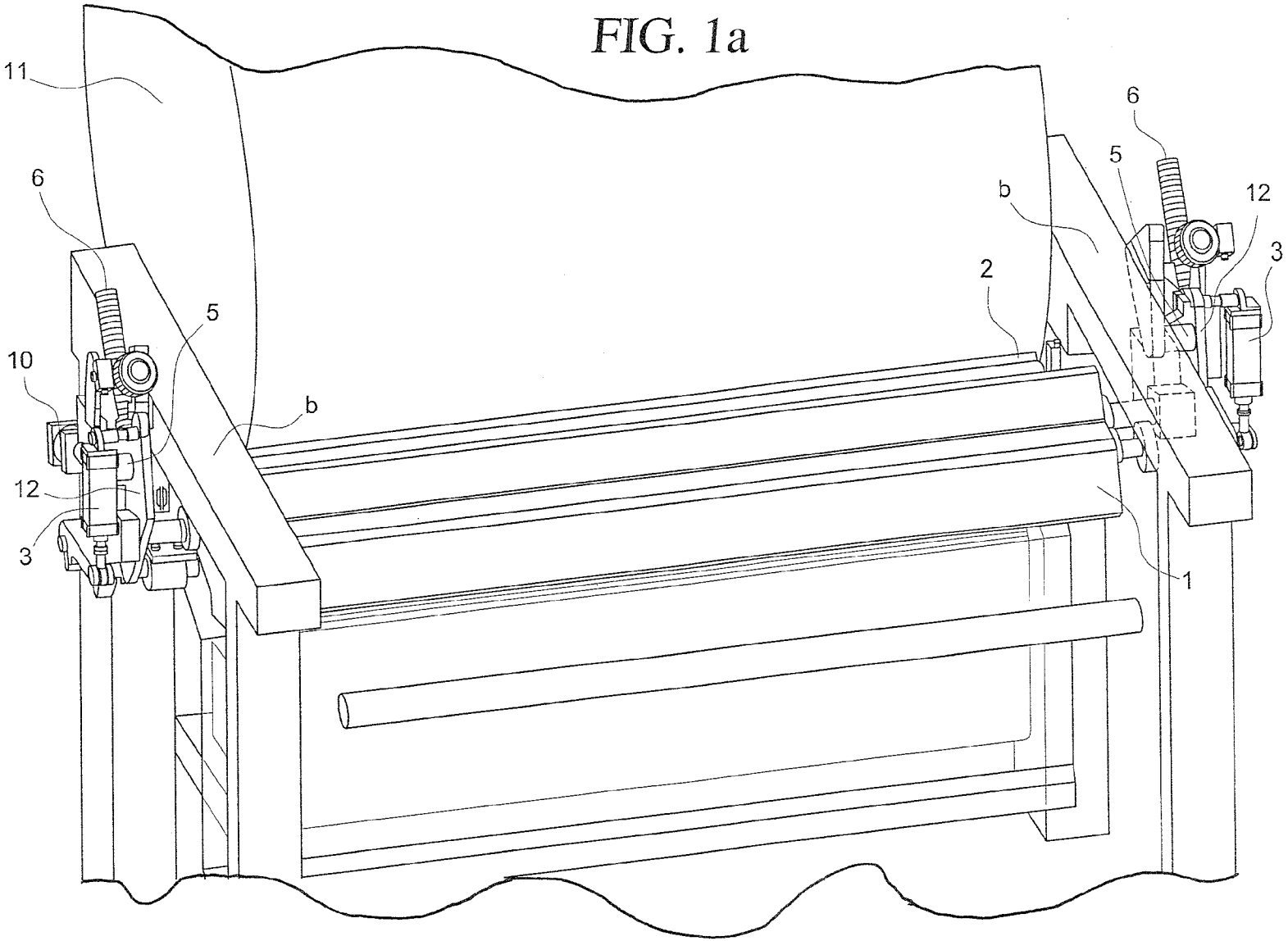
FIG. 1*a* illustrates a front view.
Figure 1B:
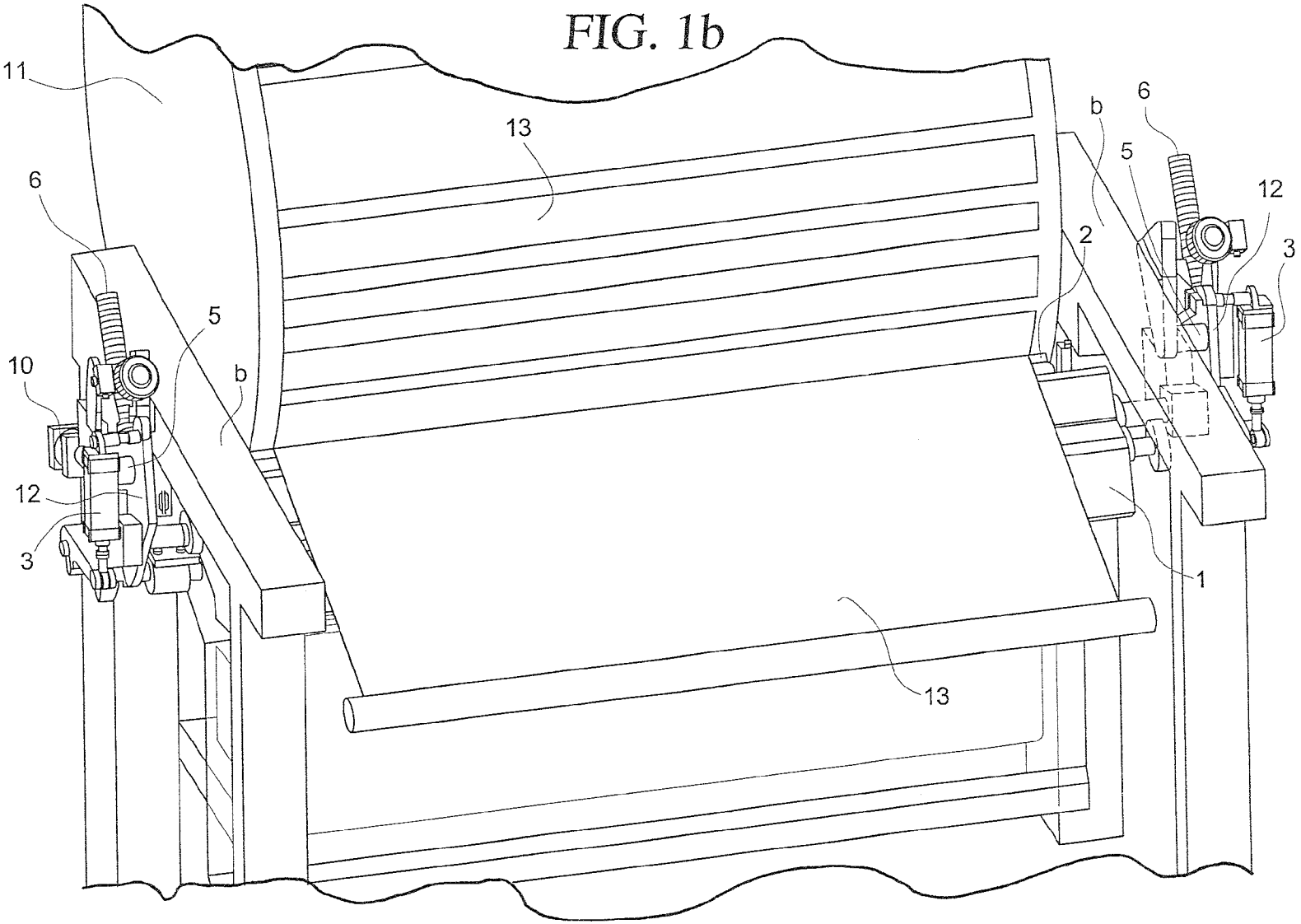
FIG. 1*b* illustrates a front view with paper.

FIG. 1 is an exploded view in the application phase of the creping (1) and cleaning (8) doctors, with the drying cylinder (11) turning at working speed, with the creping angle (CR°) on the creping blade (2) and with the cleaning angle (L°) on the cleaning blade (9).

Figure 2:
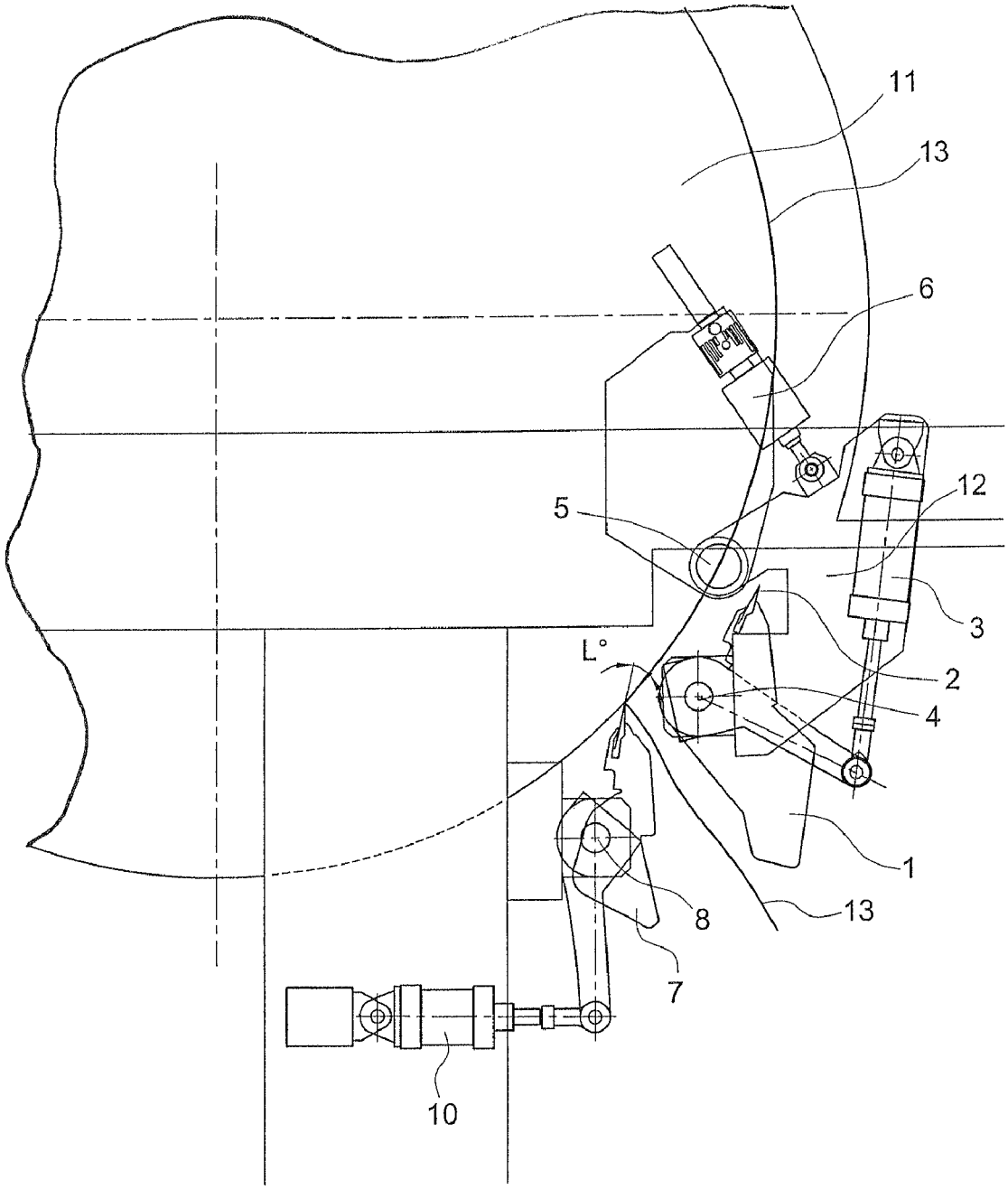
FIG. 2 illustrates the creping and cleaning doctors with new creping blades.

FIG. 2 is an exploded view similar to the foregoing one, in the application phase of substitution of the creping blade (2) with a new one.

Figure 3:
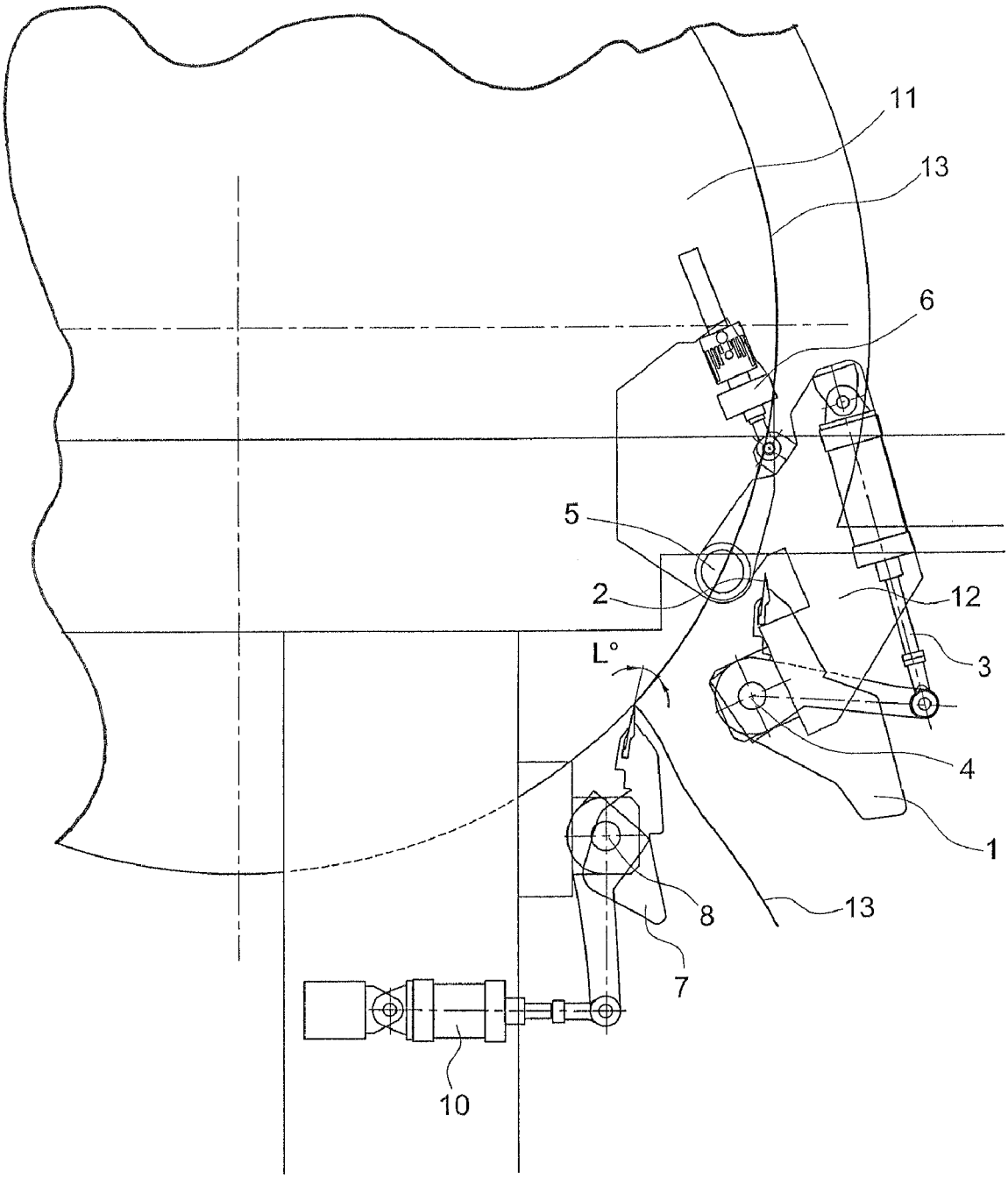
FIG. 3 illustrates a change of angle.

FIG. 3 is an exploded view similar to the foregoing ones, with the action of the means for actuating of angle variation (6), changing the angle (CR°) of application of the blade (2) relevant to creping by the angle (C°) of application of the blade (2) relevant to the cutting.

Figure 4:
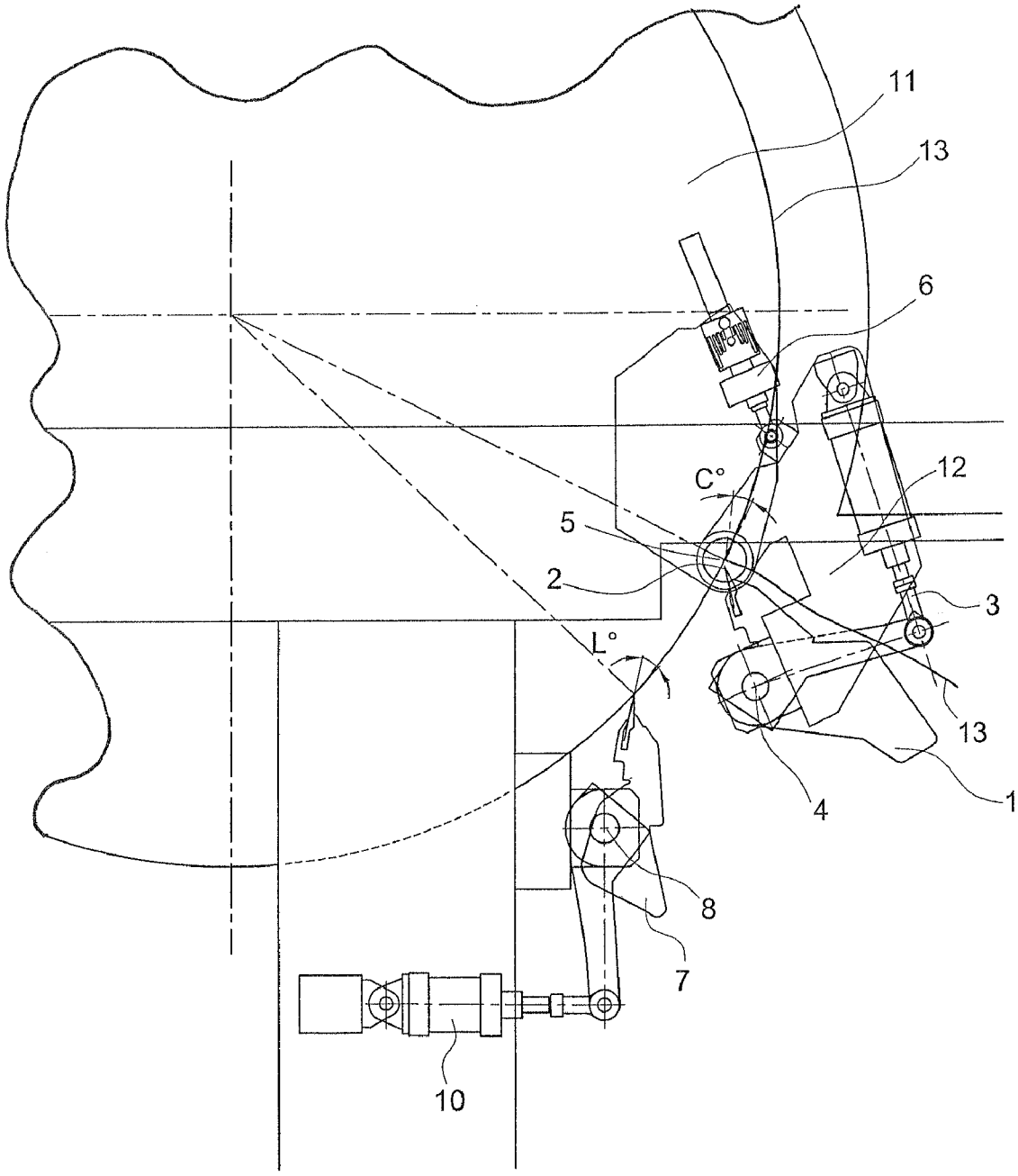
FIG. 4 illustrates another angle.
Figure 5:
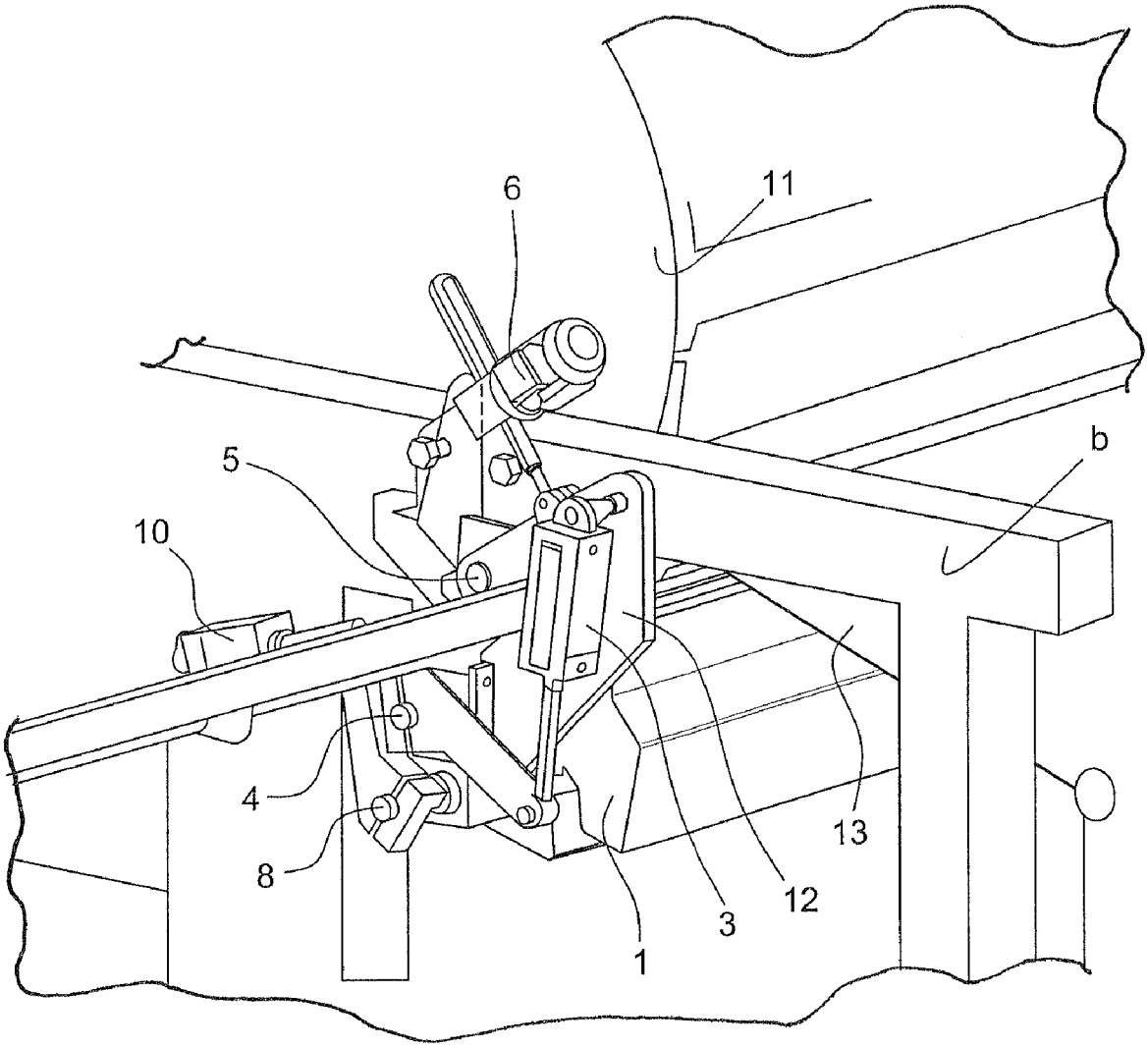
FIG. 5 illustrates a perspective view.

FIG. 4 is an exploded view similar to the foregoing ones, again applying the creping doctor (1) but with the angle of application (C°) relevant to the cutting operation.

Described as follows is an example of practical, non-limiting embodiment of this invention.

The object of the invention is a new creping and cutting procedure and facility equipped with the components and positioning necessary to carry out the manoeuvres of cutting and creping using a single doctor (1), automatically modifying the change of its angle: from creping angle (CR°) to cutting angle (C°) and vice versa.

In accordance with the invention, and according to the embodiment shown in FIGS. 1 to 4, the facility basically includes the following elements or parts making it up:

1. Creping element (creping doctor).
2. Blade which carries out the creping (creping blade).
3. Means for actuation which act on the creping doctor (1), applying the creping blade (2) to the drying cylinder (11) or removing it.
4. Pivot shaft of the creping doctor (1).
5. Pivot shaft of the support plate (12) which pulls the creping doctor with it (1) and means of actuation (3) of the blade (2) for the changing of creping angle)(CR° to cutting) (C°) and vice versa.
6. Means of actuation for the variation of creping angle (CR°) to cutting (C°) and vice versa.
7. Cleaning element (cleaning doctor).
8. Pivot point of the cleaning doctor.
9. Blade which carries out the cleaning (cleaning blade).
10. Means of actuation for the application and raising of the cleaning doctor (7).
11. Drying cylinder.
12. Support Plate.
13. Paper sheet (Paper band).

Particularly, and according to the embodiment shown, the means of actuation (3), (6), (10) are pneumatic cylinders, although they can alternatively be mechanical spindles, hydraulic cylinders or other systems of liner or angular actuation, without essentially altering the invention.

In the procedure of creping and cutting, according to the invention—see FIG. 1—:

a) The creping (1) and cleaning (8) doctors are applied with the drying cylinder (11) turning at the working speed and with the creping angle (CR°) on the creping blade (2) and with the cleaning angle (L°) on the cleaning blade (9).

The sheet (13) or paper band reaches the creping blade (2) which unsticks and crepes said sheet—see FIG. 1—.

b) When the blade (2) becomes blunt due to constant friction with the drying cylinder (11) it is necessary to substitute it with a new creping blade (2). In order to do this, the creping blade (2) is separated, raising the creping doctor (1) through actuation of the pneumatic cylinders (3). The blade is unstuck by the cleaning blade (9) and the used creping blade (2) is substituted and a new one is put in place —see FIG. 2—. When the creping doctor (1) reaches the blade-changing position the means of actuation of angle (6) variation act automatically on the support plate (12), changing the angle of application)(CR°) of the creping blade (2) to the angle of actuation)(C°) for the execution of the cutting of the sheet (13) —see FIG. 3—. When the creping blade is substituted (2) the creping doctor (1) is again applied, but with the angle of application relevant to the cutting operation)(C°) —see FIG. 4 —.

When the sheet (13) is cut, the angle of application is again modified, going from cutting (C°) to creping (CR°) through the use of the means of actuation (6), which produce the variation of angle.

The invention claimed is:

1. A creping and cutting installation for a continuous band of a paper web which travels on a drying cylinder inside a paper-making machine, comprising:

a supporting structure that supports a creping doctor blade bearing a creping blade that performs the creping process;

a support plate that can rotate on the supporting structure around a primary pivot shaft at the geometric axle which the creping blade rotates around, with the creping doctor blade being able to rotate on the support plate around a secondary pivot shaft;

a first operating mechanism supported by the support plate which is designed to make the creping doctor blade rotate between a position in which the creping blade is applied to the drying cylinder and a position for changing the blade in which the creping blade is separated from the drying cylinder;

a second operating mechanism with angle variation which is supported by the structure and which operates on the support plate, being designed to make the support plate rotate around the primary pivot shaft in order to vary the angle of application of the creping blade between a cutting angle to cut the paper web and a creping angle to crepe the paper web.

2. A method for creping and cutting a continuous band of a paper web, which travels on a drying cylinder inside the paper-making machine of claim 1 comprising:

creping the paper web via the second operating mechanism which operates on the support plate by rotating around the primary pivot shaft reaching the creping angle to crepe the paper web;

removing the creping blade from the drying cylinder by rotating the creping doctor blade towards the first operating mechanism so that the creping doctor blade arrives at the position where the creping blade can be replaced;

replacing the creping blade via the second operating mechanism which operates on the support plate so that the creping angle is replaced by the cutting angle;

cutting the paper web by rotating the creping doctor blade to the position where the creping blade is applied back to the drying cylinder with the cutting angle; and returning to the second operating mechanism which operates on the support plate with the cutting angle being replaced by the creping angle to crepe the paper web travelling on the drying cylinder inside the paper-making machine of claim 1.

3. The method according to claim 2, wherein the modification of the angle of application for the creping blade on the drying cylinder by means of the second operating mechanism is done with the paper-making machine at a standstill.

4. The method according to claim 2, wherein the modification of the angle of application for the creping blade on the drying cylinder by means of the second operating mechanism is done with the paper-making machine running without interrupting production.

* * * * *